US006816694B2

(12) United States Patent
Adachi et al.

(10) Patent No.: US 6,816,694 B2
(45) Date of Patent: Nov. 9, 2004

(54) DEVELOPER APPARATUS AND IMAGE FORMING APPARATUS

(75) Inventors: Katsumi Adachi, Nara (JP); Masamitsu Sakuma, Hirakata (JP)

(73) Assignee: Sharp Kabushiki Kaisha, Osaka (JP)

( * ) Notice: Subject to any disclaimer, the term of this patent is extended or adjusted under 35 U.S.C. 154(b) by 19 days.

(21) Appl. No.: 10/327,139

(22) Filed: Dec. 24, 2002

(65) Prior Publication Data

US 2003/0118376 A1 Jun. 26, 2003

(30) Foreign Application Priority Data

Dec. 25, 2001 (JP) ..... 2001-392293

(51) Int. Cl.[7] ..... G03G 15/08
(52) U.S. Cl. ..... 399/265
(58) Field of Search ..... 399/265, 266, 399/271, 289, 290, 291, 292, 293, 294, 295

(56) References Cited

FOREIGN PATENT DOCUMENTS

| | | | | |
|---|---|---|---|---|
| JP | 59-181371 A | | 10/1984 | |
| JP | 59-189371 A | | 10/1984 | |
| JP | 3-21967 A | | 1/1991 | |
| JP | 2001122436 A | * | 5/2001 | ..... G03G/15/08 |
| JP | 2002214910 A | * | 7/2002 | ..... G03G/15/08 |

* cited by examiner

*Primary Examiner*—Arthur T. Grimley
*Assistant Examiner*—Ryan Gleitz
(74) *Attorney, Agent, or Firm*—Birch, Stewart, Kolasch & Birch, LLP

(57) ABSTRACT

A rear electrode is arranged at a location at the back of a toner transport path opposite a supply roller, and the rear electrode is moreover embedded in a support, toner-supplying voltage from rear electrode power supply being applied to rear electrode, toner-supplying electric field being formed in the vicinity or vicinities of supply roller, toner-supplying voltage from a rear electrode power supply being varied as appropriate, and intensity of toner-supplying electric field(s) being adjusted.

20 Claims, 13 Drawing Sheets

FIG.10

| Number of phases of voltageN | Toner-supplying electric field f1(Hz) | Traveling-wave electric field f2(Hz) | Rear electrode width L(mm) | Electrode pitch λ(μ) | (L/λ)x1/(Nxf2)=A | 1/f1=B | Evaluation of [GTP134]toner transport uniformity ◎=Very good ○=Good ×=No good | =ConditionA > B is satisfied |
|---|---|---|---|---|---|---|---|---|
| 4 | 100 | 1000 | 5 | 250 | 5.00E-03 | 1.00E-02 | × | |
| 4 | 300 | 1000 | 5 | 250 | 5.00E-03 | 3.33E-03 | ○ | ☆ |
| 4 | 500 | 1000 | 5 | 250 | 5.00E-03 | 2.00E-03 | ◎ | ☆ |
| 4 | 1000 | 1000 | 5 | 250 | 5.00E-03 | 1.00E-03 | ◎ | ☆ |
| 4 | 300 | 1000 | 1 | 250 | 1.00E-03 | 3.33E-03 | × | |
| 4 | 300 | 1000 | 2 | 250 | 2.00E-03 | 3.33E-03 | × | |
| 4 | 300 | 1000 | 3 | 250 | 3.00E-03 | 3.33E-03 | × | |
| 4 | 300 | 1000 | 7 | 250 | 7.00E-03 | 3.33E-03 | ◎ | ☆ |
| 4 | 300 | 500 | 3 | 250 | 6.00E-03 | 3.33E-03 | ○ | ☆ |
| 4 | 300 | 750 | 3 | 250 | 4.00E-03 | 3.33E-03 | ○ | ☆ |
| 4 | 300 | 1250 | 3 | 250 | 2.40E-03 | 3.33E-03 | × | |
| 4 | 300 | 1500 | 3 | 250 | 2.00E-03 | 3.33E-03 | × | |
| 4 | 300 | 1000 | 5 | 130 | 9.62E-03 | 3.33E-03 | ◎ | ☆ |
| 4 | 300 | 1000 | 5 | 500 | 2.50E-03 | 3.33E-03 | × | |
| 3 | 100 | 1000 | 5 | 250 | 6.67E-03 | 1.00E-02 | × | |
| 3 | 300 | 1000 | 5 | 250 | 6.67E-03 | 3.33E-03 | ◎ | ☆ |
| 3 | 500 | 1000 | 5 | 250 | 6.67E-03 | 2.00E-03 | ◎ | ☆ |
| 3 | 1000 | 1000 | 5 | 250 | 6.67E-03 | 1.00E-03 | ◎ | ☆ |

| d1 (μ) | d2 (μ) | Evaluation of toner transport ◎=Very good ○=Good ×=No good | =Condition d1 >d2 is satisfied |
|---|---|---|---|
| 80 | 30 | ◎ | ☆ |
| 80 | 55 | ○ | ☆ |
| 80 | 85 | × (Decrease in amount transported) | |
| 80 | 100 | × (Sharp drop in amount transported) | |
| 50 | 30 | ○~◎ | ☆ |
| 50 | 55 | × (Decrease in amount transported) | |

| d1 (μm) | B(= λ −w) (μm) | λ (μm) | w (μm) | Evaluation of toner supply controllability ◎=Very good ○=Good ×=No good | =Condition d1 <Bs is satisfied |
|---|---|---|---|---|---|
| 50 | 168 | 250 | 82 | ◎ | ☆ |
| 50 | 123 | 250 | 127 | ◎ | ☆ |
| 80 | 168 | 250 | 82 | ◎ | ☆ |
| 80 | 123 | 250 | 127 | ○~◎ | ☆ |
| 150 | 168 | 250 | 82 | ○ | ☆ |
| 150 | 123 | 250 | 127 | × | — |
| 50 | 75 | 130 | 55 | ○ | ☆ |
| 80 | 75 | 130 | 55 | × | — |
| 150 | 75 | 130 | 55 | × | — |
| 50 | 232 | 500 | 268 | ◎ | ☆ |
| 80 | 232 | 500 | 268 | ◎ | ☆ |
| 150 | 232 | 500 | 268 | ◎ | ☆ |

(a)

(b)

(c)

DEVELOPER APPARATUS AND IMAGE FORMING APPARATUS

This nonprovisional application claims priority under 35 U.S.C. §119(a) on patent application No. 2001-392293 filed in JAPAN on Dec. 25, 2001, which is herein incorporated by reference.

BACKGROUND OF INVENTION

1. Field of Invention

The present invention relates to a developer apparatus and to an image forming apparatus wherein developer material is transported by a traveling-wave electric field and a latent electrostatic image is developed by means of this developer material.

2. Conventional Art

In the field of copiers, printers, and other such image forming apparatuses where electrophotography is employed, developer apparatuses utilizing noncontact methods in which developer material is transported to the vicinity of an image carrier and developer material is cast onto a latent electrostatic image on the image carrier to develop this latent electrostatic image have drawn attention. Such noncontact methods include the powder cloud method, the jumping method, and methods employing an electric field curtain (traveling-wave electric field).

Methods employing traveling-wave electric fields are described, for example, at Japanese Patent Application Publication Kokoku No. H5-31146 (1993), Japanese Patent Application Publication Kokoku No. H5-31147 (1993), and elsewhere. In such descriptions, a multiplicity of electrodes are embedded in a developer material transport path, polyphase AC voltage(s) is or are applied to these electrodes to form a traveling-wave electric field, and developer material in the transport path is transported to an image carrier by means of this traveling-wave electric field. Developer material transported to the vicinity of the image carrier and cast onto a latent electrostatic image on the image carrier adheres to the latent electrostatic image. As a result, the latent electrostatic image on the image carrier is developed.

Furthermore, at Japanese Patent Application Publication Kokai No. H3-21967 (1991), not only is developer material in a transport path transported by a traveling-wave electric field, but art is also disclosed in which a precharge roller made of urethane foam and a blade that contacts the precharge roller are provided, friction between the precharge roller and the transport path causing precharging of developer material while developer material layer thickness is at the same time restricted, as a result of which uniform and appropriate charging, as well as stable transport, of developer material are achieved, while scattering of developer material and fogging of the image are prevented.

However, as a result of intensive research on the part of the inventors of the present invention, it has been found that the foregoing conventional developer apparatuses have problems such as the following.

The traveling-wave electric field for transport of developer material is formed due to differences in electric potential between the respective electrodes of the transport path and the developer material supply member which supplies the developer material to the transport path. For this reason, it is necessary to not only apply AC voltage(s) Vac to the electrodes of the transport path but to also apply prescribed DC bias voltage(s) Vd to the developer material supply member, as shown at FIG. 15(*a*). Furthermore, where the developer material supply member is additionally outfitted with restricting members for restricting developer material layer thickness, supplemental supply members for smooth supply of developer material, and so forth, it will be necessary to apply DC voltage(s) to the restricting members, supplemental supply members, and so forth so as to respectively bias these relative to the DC bias voltage Vd at the developer material supply member.

Now, the developer material becomes charged through ionic irradiation by a corona discharge device, immersion in an electric field, triboelectric action, or the like. However, the amount of charge acquired will vary depending upon ambient conditions and will vary as a function of time. Similarly, developer material layer thickness (the amount of developer material adhering to media) will also vary. Such variations in developer material contribute to variation in the amount of developer material supplied from the developer material supply member to the transport path, and therefore to variation in the amount of developer material supplied from the transport path to the image carrier, causing development nonuniformity and interfering with stable image formation.

One proposal for increasing stability of the amount of developer material which is supplied is a method wherein the traveling-wave electric field for transport of developer material is varied. For example, if there is a decrease in the amount of developer material being supplied, the difference in electric potential between AC voltage Vac and the DC bias voltage Vd at the developer material supply member might be increased by raising DC bias voltage Vd as shown in FIG. 15(*b*) and/or lowering AC voltage Vac as shown in FIG. 15(*c*), thereby increasing the intensity of the traveling-wave electric field and causing the amount of developer material being supplied to increase.

Where AC voltage Vac is varied as shown in FIG. 15(*c*), however, the fact that it will be necessary to uniformly vary at least three or four phases of high-voltage AC voltage makes for complicated voltage supply circuitry for supply of the high-voltage AC voltage(s), which leads to increased cost. And if a relative shift were to develop among the respective high-voltage AC voltages, transport of developer material would become destabilized and the amount of developer material being supplied would likewise become destabilized. Accordingly, in addition to the fact that voltage supply circuitry is made complicated by additional equipment in the form of a mechanism for varying the respective high-voltage AC voltages, as stable operation of the voltage supply circuitry must be maintained and as it will be necessary to simultaneously achieve both stable operation as well as a mechanism for varying respective high-voltage AC voltages, increases in cost will be unavoidable.

Furthermore, where the DC bias voltage Vd at the developer material supply member is varied as shown in FIG. 15(*b*), as it will also be necessary, in conjunction with variation of the DC bias voltage Vd, to vary the respective DC bias voltages at the aforementioned restricting members for restricting developer material layer thickness, supplemental supply members for smooth supply of developer material, and so forth, here again this will complicate the voltage supply circuitry for supply of respective DC bias voltages, increasing cost. Furthermore, because variation of the respective DC bias voltages at such members will result in variation in the electric field distribution in the vicinity of the developer material transport path, it is entirely possible that this will produce unexpected behavior in the development process or affect transport of developer material.

SUMMARY OF INVENTION

It is therefore an object of the present invention to provide a developer apparatus and an image forming apparatus conceived in light of the foregoing problems in the conventional art and permitting adjustment in the amount of developer material supplied through a simple constitution to achieve improved stability in image formation while holding increases in cost to a minimum.

In order to solve the foregoing problems, the present invention, in the context of a developer apparatus equipped with one or more transport path or paths wherein a plurality of electrodes are arranged in a row or rows so as to be mutually separated by a prescribed spacing or spacings and with one or more developer material supply means arranged at the front side of at least one of the transport path or paths, developer material being supplied from at least one of the developer material supply means to the front of at least one of the transport path or paths, a polyphase alternating current voltage or voltages being applied to respective electrodes of at least one of the transport path or paths, a traveling-wave electric field or fields being formed, at least one of the traveling-wave electric field or fields causing at least a portion of the developer material to be transported along the front of at least one of the transport path or paths to an image carrier or carriers, and supply of this developer material to the image carrier or carriers causing a latent electrostatic image or images on at least one of the image carrier or carriers to be developed, is such that a rear electrode or electrodes is or are arranged at a location or locations at the back side of at least one of the transport path or paths opposite at least one of the developer material supply means, a developer-material-supplying electric field or fields being formed between at least one of the rear electrode or electrodes and at least one of the developer material supply means.

A developer apparatus having such constitution according to the present invention permits formation of developer-material-supplying electric field(s) between developer material supply mean(s) and rear electrode(s) at location(s) at the back side(s) of transport path(s). Accordingly, developer-material-supplying electric field(s) will be formed near developer material supply path(s) between developer material supply mean(s) and transport path(s) and will exert an effect upon the amount(s) of developer material supplied. Furthermore, intensity or intensities of developer-material-supplying electric field(s) may be adjusted by altering voltage(s) applied to rear electrode(s). Amount(s) of developer material supplied from developer material supply mean(s) to transport path(s) may therefore be controlled by altering voltage(s) applied to rear electrode(s) and adjusting intensity or intensities of developer-material-supplying electric field(s). This eliminates the need to vary DC bias voltage(s) at developer material supply mean(s) and/or polyphase AC voltage(s) applied to respective electrodes in transport path(s), therefore making it possible to avoid complicated voltage supply circuitry for supply of polyphase AC voltage(s) and DC bias voltage(s) and concomitant increases in cost, and moreover permitting achievement of improved stability in image formation without destabilizing transport of developer material or producing unexpected behavior in the development process or effect on transport of developer material.

Furthermore, in the present invention, a width of at least one of the rear electrode or electrodes in at least one developer material transport direction is greater than a pitch or pitches between respective electrodes in at least one of the transport path or paths.

If width(s) of rear electrode(s) were to be made smaller than pitch(es) between respective electrodes in transport path(s), developer-material-supplying electric field(s) produced by rear electrode(s) would be more or less shielded by respective electrodes in transport path(s), making it impossible to use developer-material-supplying electric field(s) to control amount(s) of developer material supplied. Width(s) of rear electrode(s) are therefore made greater than pitch(es) between respective electrodes in transport path(s).

Moreover, in the present invention, at least one of the rear electrode or electrodes is disposed with a bias in at least one developer material transport direction relative to at least one of the developer material supply means.

Arranging rear electrode(s) in such fashion causes developer-material-supplying electric field(s) produced by rear electrode(s) to be biased in developer material transport direction(s) relative to developer material supply mean(s). In such a case, it is possible for developer material to be smoothly directed from developer material supply mean(s) to transport path(s), improving developer material transport stability. If rear electrode(s) were disposed with bias(es) in opposite direction(s) relative to developer material supply mean(s), developer-material-supplying electric field(s) produced by rear electrode(s) would be biased in opposite direction(s) relative to developer material supply mean(s), increasing the tendency for developer material to become concentrated at location(s) to the front of region(s) between developer material supply mean(s) and transport path(s), causing developer material itself to block developer material transport path(s) at such locations and causing developer material to no longer be able to smoothly pass between developer material supply mean(s) and transport path(s), and destabilizing developer material transport.

Furthermore, in the present invention, a length of at least one of the rear electrode or electrodes in a direction perpendicular to at least one developer material transport direction is less than a length or lengths of respective electrodes in at least one of the transport path or paths in said perpendicular direction.

For each of the several phases of the polyphase AC voltage(s), respective electrodes of transport path(s) are connected in common and the AC voltage(s) is or are applied to the respective electrodes connected in common. The region of the respective electrodes at which they are connected in common is the ends of the respective electrodes. For this reason, the pattern formed by the ends of respective electrodes is made complex, the traveling-wave electric field(s) produced by the respective electrodes being disrupted in the region of this complex pattern. Accordingly, transport of developer material is destabilized at the ends of respective electrodes, it being preferred that transport of developer material not take place thereat. Length(s) of rear electrode(s) is or are therefore made smaller than length(s) of respective electrodes, inhibiting transport of developer material in the vicinity of the ends of respective electrodes, there being no supply of developer material to the vicinity of the ends of respective electrodes.

Moreover, in the present invention, at least one of the developer-material-supplying electric field or fields is an alternating electric field.

Developer material tends to accumulate in layers and adhere to developer material supply mean(s). For this reason, alternating electric field(s) is or are chosen for use as developer-material-supplying electric field(s), developer material layers being broken up by the periodic variation between high and low developer-material-supplying electric field intensities. This permits supply of developer material to be made uniform and stable. Also, while traveling-wave electric field(s) comprises or comprise a plurality of alternating electric field(s), the frequency or frequencies, electric field intensity or intensities, phase difference(s), and so forth thereof are optimized for transport of developer material. Accordingly, it is desirable that, completely separate from traveling-wave electric field(s), alternating electric field(s) representing developer-material-supplying electric field(s) be such that the frequency or frequencies and/or electric field intensity or intensities thereof is or are optimized for uniform and stable supply of developer material.

Furthermore, in the present invention, an alternating current voltage or voltages corresponding to the alternating electric field is or are applied to at least one of the rear electrode or electrodes.

If AC voltage(s) corresponding to alternating electric field(s) were applied to developer material supply mean(s), such alternating electric field(s) would also act at transport path(s) in the vicinity or vicinities of developer material supply mean(s). Or such alternating electric field(s) might also act at restricting members for restricting developer material layer thickness, supplemental supply members for smooth supply of developer material, and so forth. This might then cause problems with layer formation of developer material being transported along the front(s) of transport path(s). It is moreover possible that action of such alternating electric field(s) could extend as far as the vicinity or vicinities of development region(s) where latent electrostatic image(s) on image carrier(s) is or are being developed, and if electric field(s) in the vicinity or vicinities of such development region(s) is or are disrupted this would negatively affect the development process. AC voltage(s) corresponding to alternating electric field(s) is or are therefore applied to rear electrode(s), causing region(s) at which such alternating electric field(s) is or are produced to be concentrated between rear electrode(s) and developer material supply mean(s), and inhibiting action of such alternating electric field(s) at regions peripheral thereto.

Moreover, in the present invention, the condition $(L/\lambda)\times(1/(N\times f2))>1/f1$ is satisfied, where f1 is a frequency of the alternating electric field, N is a number of phases of at least one of the polyphase alternating current voltage or voltages which forms or form at least one of the traveling-wave electric field or fields, f2 is a frequency of at least one of the traveling-wave electric field or fields, L is a width of at least one of the rear electrode or electrodes in at least one developer material transport direction, and $\lambda$ is at least one of the pitch or pitches between respective electrodes in at least one of the transport path or paths.

Taking the case of two adjacent electrodes in a transport path, the time during which developer material is moving between said respective electrodes corresponds to the time during which an electric potential difference exists between said respective electrodes. For this reason, taking the example where polyphase AC voltage(s) is or are four-phase, choosing four rectangular waves mutually differing in phase by 90° and having duty cycles of 50% or more for use as four-phase AC voltage(s) maximizes the time during which an electric potential difference exists between two adjacent electrodes and increases the time during which movement of developer material occurs. Here, the time during which developer material is moving across the space between two adjacent electrodes will be $1/(N\times f2)$, where N is the number of phases of polyphase AC voltage and f2 is traveling-wave electric field frequency (Hz). Furthermore, there will be $L/\lambda$ spaces between respective electrodes within rear electrode region(s), where L is rear electrode width (m) and k is pitch (m) between respective electrodes in a transport path. Accordingly, $\Delta t=(L/\lambda)\times(1/(N\times f2))$, where $\Delta t$ is the time during which developer material is moving in rear electrode region(s). Moreover, in order that alternating electric field(s) representing developer-material-supplying electric field(s) act on developer material for at least one cycle in rear electrode region(s), and to thus promote uniformity and stability in supply of developer material, it will be necessary to make $\Delta t$ greater than alternating electric field period (1/f1), where f1 is alternating electric field frequency (Hz). Accordingly, if the condition $(L/\lambda)\times(1/(N\times f2))>1/f1$ is satisfied, supply of developer material will be made uniform and stable, and image formation will in turn be made stable.

In addition, where polyphase AC voltage(s) is or are three-phase, three rectangular waves mutually differing in phase by 90° and having duty cycles of 50% or more may be chosen for use as three-phase AC voltage(s).

Furthermore, in the present invention, supply of developer material from at least one of the developer material supply means to the front of at least one of the transport path or paths is stopped by switching at least one of the developer-material-supplying electric field or fields to a non-developer-material-supplying electric field.

Stopping supply of developer material from developer material supply mean(s) to transport path(s) in mid-supply thereof causes binding of developer material layer(s) at the front(s) of transport path(s), and this negatively affects supply of developer material the next time that supply thereof is attempted. This might for example deleteriously affect attempts to increase uniformity and stability of supply, or vibrations from the exterior might serve to dislodge and scatter developer material layer(s). Supply of developer material to transport path(s) is therefore stopped through use of non-developer-material-supplying electric field(s). If developer material in transport path(s) is transported in such fashion without leaving any of it unrecovered, binding of developer material layer(s) at the front(s) of transport path(s) can be avoided. And not only that, but because switching from developer-material-supplying electric field(s) to non-developer-material-supplying electric field(s) is carried out by merely switching voltages applied at rear electrode(s), such effect may be achieved simply and inexpensively.

Moreover, in the present invention, the condition $d1>d2$ is satisfied, where d1 is a distance separating at least one of the rear electrode or electrodes and respective electrodes of at least one of the transport path or paths, and d2 is a distance separating respective electrodes of at least one of the transport path or paths and the front of at least one of the transport path or paths.

If distance(s) d1 separating rear electrode(s) and respective electrodes of transport path(s) is or are too small, there will be an increase in the degree to which traveling-wave electric field(s) produced by respective electrodes is or are directed toward rear electrode(s), reducing traveling-wave electric field intensity or intensities and reducing developer material transport capability. Distance(s) d2 separating respective electrode(s) of transport path(s) and the front(s) of transport path(s) is or are therefore made smaller than distance(s) d1 separating rear electrode(s) and respective electrodes of transport path(s), this permitting traveling-wave electric field intensity or intensities to be maintained.

Furthermore, in the present invention, the condition $Bs>d1$ is satisfied, where Bs is a distance separating respective electrodes of at least one of the transport path or paths, and d1 is a distance separating at least one of the rear electrode or electrodes and respective electrodes of at least one of the transport path or paths.

If distance(s) Bs separating respective electrodes of transport path(s) is or are too small relative to distance(s) d1 separating rear electrode(s) and respective electrodes of transport path(s), or if distance(s) d1 is or are too large relative to distance(s) Bs, developer-material-supplying electric field(s) produced by rear electrode(s) will be more or less shielded by respective electrodes in transport path(s), making it impossible to use developer-material-supplying electric field(s) to control amount(s) of developer material supplied. Distance(s) Bs separating respective electrodes of transport path(s) is or are therefore made larger than distance(s) d1 separating rear electrode(s) and respective electrodes of transport path(s).

Moreover, an image forming apparatus in accordance with the present invention is equipped with at least one developer apparatus as described above.

Such an image forming apparatus in accordance with the present invention also permits attainment of operation and benefits similar to those described with respect to the foregoing developer apparatus(es).

BRIEF DESCRIPTION OF DRAWINGS

FIG. 10 is a table showing results of testing in which toner transport was evaluated and determination was made as to whether the condition $(L/\lambda)\times(1/(N\times f2))>1/f1$ was satisfied with respectively appropriately chosen values for number N of phases of polyphase AC voltage, alternating electric field frequency f1, traveling-wave electric field frequency f2, rear electrode width L, and pitch λ between respective traveling-wave-generating electrodes.

DESCRIPTION OF PREFERRED EMBODIMENTS

Below, embodiments of the present invention are described in detail with reference to the attached drawings.

Figure 1:
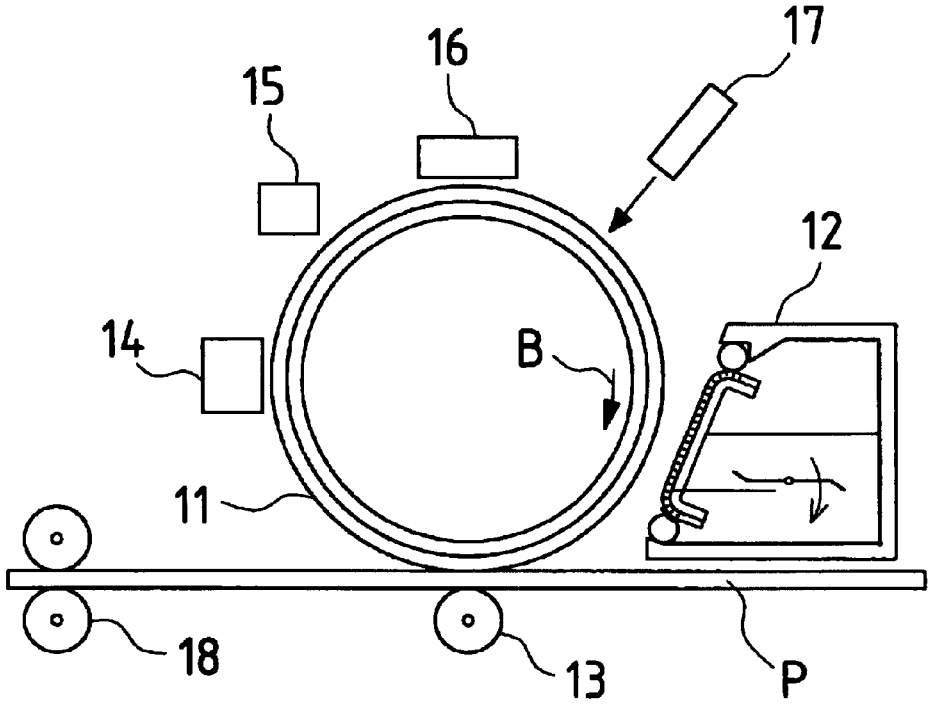
FIG. 1 is a side view showing in schematic form an image forming apparatus representing an application of an embodiment of a developer apparatus in accordance with the present invention.

FIG. 1 is a side view showing in schematic form an image forming apparatus representing an application of an embodiment of a developer apparatus in accordance with the present invention. This image forming apparatus employs electrophotography to form an image, developer apparatus 12, transfer apparatus 13, cleaning apparatus 14, charge removal apparatus 15, charging apparatus 16, exposure apparatus 17, and so forth being arranged about photosensitive drum 11 in order from an upstream point in the direction of rotation thereof. Furthermore, fixing apparatus 18 is arranged at a downstream point in the direction of transport of recording paper P.

In the image forming apparatus of present embodiment, the surface of photosensitive drum 11 is uniformly charged by charging apparatus 16 as photosensitive drum 11 is made to rotate in the direction of arrow B. Moreover, the surface of photosensitive drum 11 is scanned with laser light emitted from exposure apparatus 17 toward photosensitive drum 11 as this laser light is modulated based on image data representing an image, forming a latent electrostatic image on photosensitive drum 11. In addition, developer apparatus 12 causes toner to adhere to the latent electrostatic image, forming a toner image, this toner image is transferred by transfer apparatus 13 from photosensitive drum 11 to PPC paper or other such recording paper P, and the toner image on recording paper P is fixed through application of heat and application of pressure by fixing apparatus 18. Thereafter, any toner remaining on photosensitive drum 11 is removed by cleaning apparatus 14, cleaning photosensitive drum 11, and any charge remaining on the surface of photosensitive drum 11 is removed by charge removal apparatus 15.

Photosensitive drum 11 is for example an aluminum or other such metal drum, formed on the outside circumference of which is a thin-film-like photoconductive layer comprising amorphous silicon (a-Si), selenium (Se), organic photo semiconductor (OPC), or the like.

Charging apparatus 16 is for example equipped with a corona charging unit comprising a tungsten wire or other such charge-generating wire, sheet metal shielding, and a grid plate, or with a charge-generating roller, charge-generating brushes, or the like. Exposure apparatus 17 is equipped with a semiconductor laser which emits laser light, a laser light scanning mechanism, and so forth. Transfer apparatus 13 is equipped with a corona charging unit, or with a charge-generating roller, charge-generating brushes, or the like. Cleaning apparatus 14 is a cleaning blade or the like which is capable of coming into sliding contact with the surface of the photosensitive drum 11. Charge removal apparatus 15 is a charge-removing lamp or the like.

But note that there is no objection to employment of other types of components at photosensitive drum 11 and respective apparatuses 13 through 18.

Figure 2:
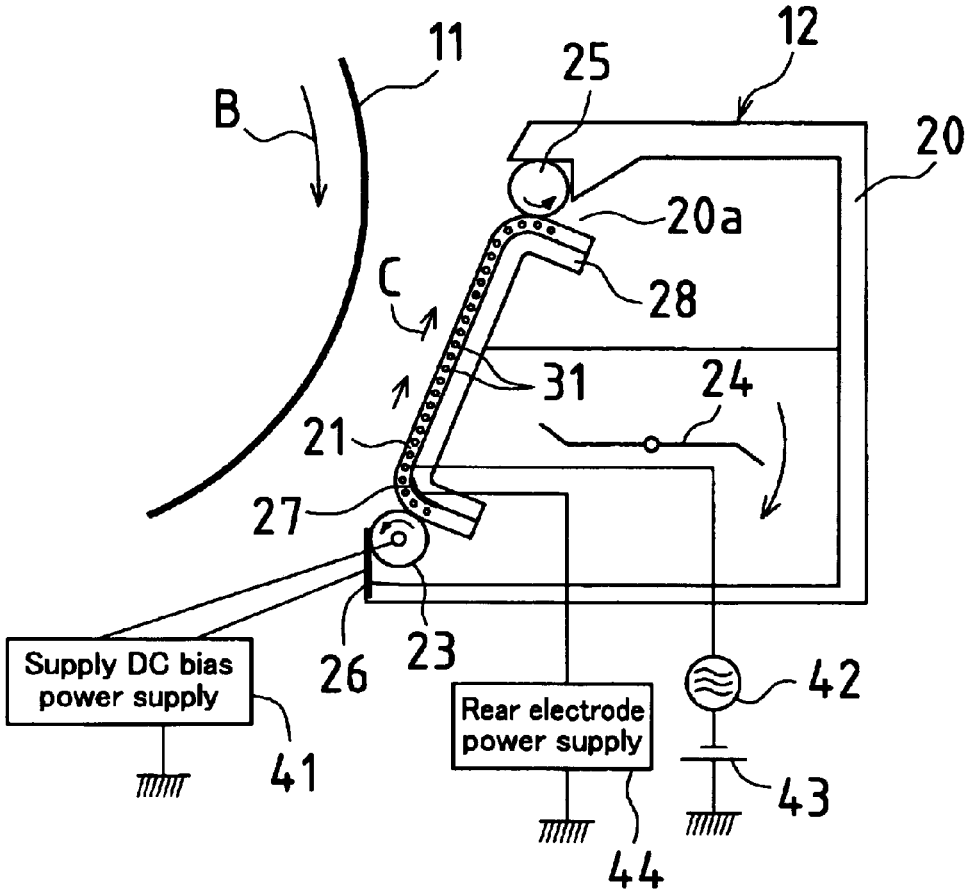
FIG. 2 is a side view showing the developer apparatus of the present embodiment.

Next, as shown in FIG. 2, developer apparatus 12 of the present embodiment is equipped with developer tank 20 containing toner; toner transport path 21 wherein generation of a traveling-wave electric field causes toner to be transported; supply roller 23 which supplies toner from developer tank 20 to toner transport path 21; mixing paddle 24 which agitates toner within developer tank 20, causing it to move toward supply roller 23; recovery roller 25 which recovers toner from toner transport path 21, returning it to developer tank 20; blade 26; and so forth.

Opening 20*a* in developer tank 20 faces the side of photosensitive drum 11, support 28 being secured to this opening 20*a*, and toner transport path 21 being secured to the outside circumferential surface of this support 28. Opening 20*a* of developer tank 20 is accordingly blocked by toner transport path 21, a toner reservoir being formed at the inside thereof.

As examples of material which may be used for support 28, ABS (Acrylonitrile-Butadiene-Styrene) resin and the like may be cited. The purpose of support 28 being to support toner transport path 21, there is no particular limitation as to the structure employed therefor. Furthermore, whereas support 28 is c-shaped, there is no particular limitation as to the shape thereof. As examples of other shapes which may be employed therefor, such component may be semicylindrical, may entail a gentle curve inclined at something of an angle, and so forth.

As examples of material which may be used for supply roller 23, silicone, urethane, EPDM (ethylene-propylene-diene-methylene copolymer), and other such solid rubbers, foam rubbers, and the like may be cited. Furthermore, because the electric potential of supply roller 23 is determined by the supply roller DC bias voltage applied to supply roller 23 by supply DC bias power supply 41, carbon black and/or ionic electroconductor material may be added to impart supply roller 23 with electrical conductivity. Supply roller 23, disposed alongside the lower end of toner transport path 21, is supported so as to allow rotation, is driven in rotational fashion in a counterclockwise direction by means of a motor or the like, not shown, and supplies toner to toner transport path 21. During supply of this toner, supply roller 23 restricts the thickness of the layer of toner which adheres to toner transport path 21 as it charges the toner by virtue of its electric potential and the pressure with which it contacts the toner.

The material used for blade 26 may be the same as that used for supply roller 23, or it may be different therefrom. Blade 26 is sheet-like, is capable of coming into sliding contact with supply roller 23, receives application of blade DC bias voltage from supply DC bias power supply 41, and restricts toner layer thickness and the amount of charge thereon. Supplemental supply member(s) (not shown) for smooth supply of developer material may also be provided, supplemental supply member DC bias voltage(s) being applied thereto from supply DC bias power supply 41.

There is no particular limitation as to the material used for recovery roller 25. Recovery roller 25, disposed alongside the upper end of toner transport path 21, is supported so as to allow rotation, and is driven in rotational fashion in a counterclockwise direction by means of a motor or the like, not shown. Recovery roller 25, being capable of coming into sliding contact with toner transport path 21, removes electric charge from toner transport path 21 and scrapes and removes toner remaining on toner transport path 21, cleaning toner transport path 21 and recovering toner, returning it to developer tank 20.

Figure 3:
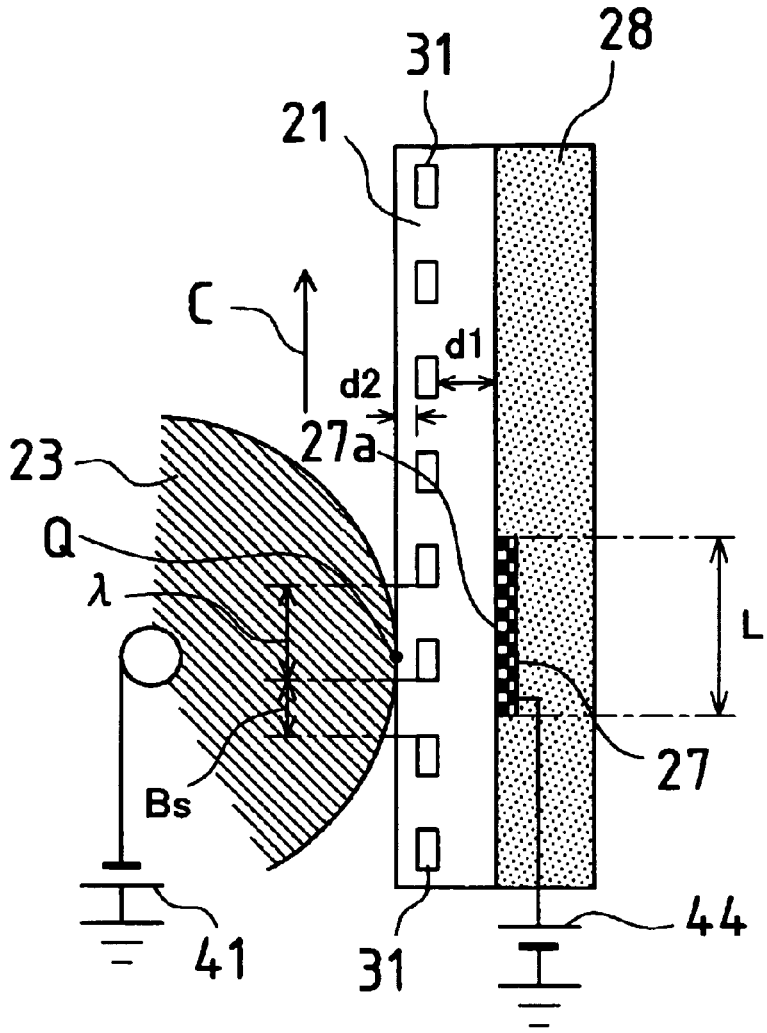
FIG. 3 is a partial enlarged view showing a toner transport path and supply roller in the developer apparatus of FIG. 2.

Toner transport path 21, may be equipped with a Flexible Print Circuit (FPC) or the like, has a structure for example such as that shown in FIG. 3, wherein an electrode layer is formed on substrate on the order of 25 to 100$\mu$ in thickness and comprising polyimide or the like, a surface protective layer on the order of 10 to 50$\mu$ in thickness and comprising polyimide or the like being laminated thereover. The electrode layer comprises copper foil of thickness on the order of 15 to 30 $\mu$, a plurality of traveling-wave-generating electrodes 31 being formed thereby.

Note at FIG. 3 that toner transport path 21 is shown in simplified fashion as a flat structure.

Figure 4:
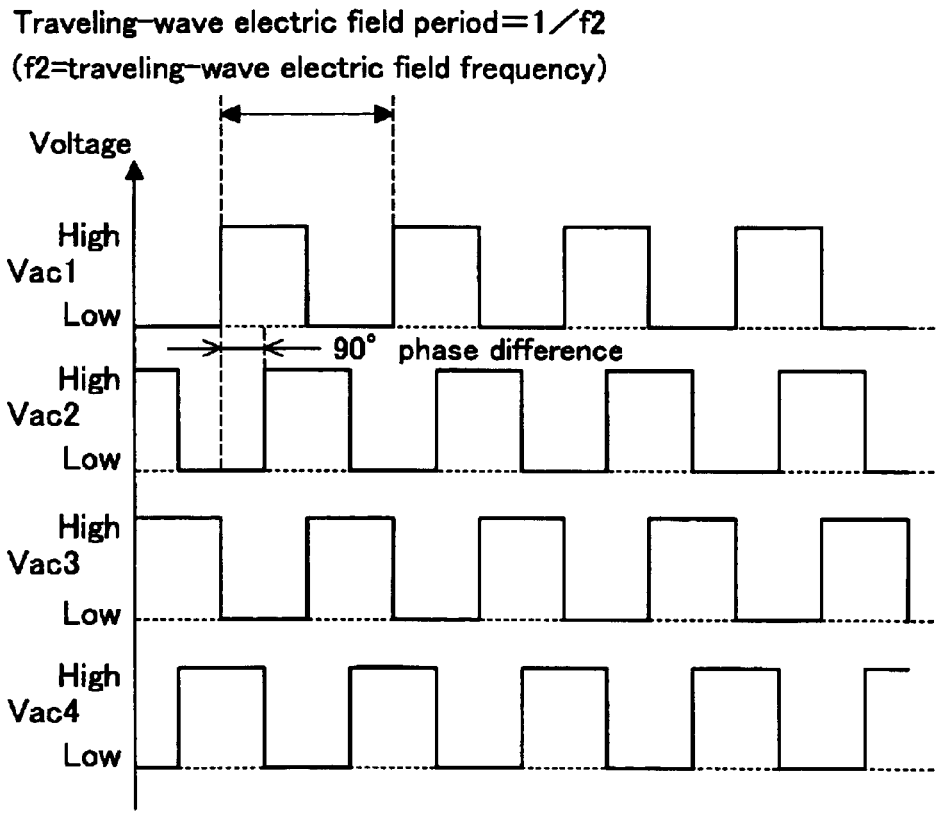
FIG. 4 is a drawing showing four-phase AC voltage waveforms applied to respective traveling-wave-generating electrodes in a toner transport path of the developer apparatus of FIG. 2.

At toner transport path 21, respective traveling-wave-generating electrodes 31 have widths of for example approximately 40$\mu$ to 250 $\mu$, are arranged in parallel, being spaced apart at 100 dpi to 300 dpi (approximately 250 $\mu$ to approximately 85 $\mu$), and are provided from the lower end of toner transport path 21 to the upper end thereof. Furthermore, respective traveling-wave-generating electrodes 31 are divided into a plurality of groups, there being on the order of three or four of such electrodes to a group. In addition, polyphase AC voltage(s) is or are applied separately to each group of the respective traveling-wave-generating electrodes 31. For example, taking the case where four traveling-wave-generating electrodes 31 form one group and four-phase AC voltage is applied thereto, the four phases of AC voltage Vac1 through Vac4 from a polyphase AC power supply 42 such as is shown in FIG. 4 might respectively be applied to the four respective traveling-wave-generating electrodes 31. This permits traveling-wave electric field(s) to be formed.

Because respective traveling-wave-generating electrodes 31 are provided from the lower end of toner transport path 21 to the upper end thereof, traveling-wave electric field(s) is or are formed from the lower end of toner transport path 21 to the upper end thereof. Such traveling-wave electric field(s) causes or cause toner to be transported from the lower end of toner transport path 21 to the upper end thereof, in the direction indicated by arrow C. The four-phase AC voltage(s) may be chosen to be, for example, on the order of 100 V to 3 kV so as to prevent occurrence of dielectric breakdown between respective traveling-wave-generating electrodes 31. Furthermore, the frequency or frequencies thereof may be chosen to be on the order of 20 Hz to 10 kHz. Moreover, four-phase AC voltage(s) and frequency or frequencies thereof may be chosen as appropriate in correspondence to shape of respective traveling-wave-generating electrodes 31, toner transport speed, toner properties, and so forth.

As noted above, supply roller 23 supplies toner from developer tank 20 to toner transport path 21. In addition, traveling-wave electric field(s) causes or cause toner to be transported from the lower end of toner transport path 21 to the upper end thereof. Moreover, recovery roller 25 recovers toner from toner transport path 21, returning it to developer tank 20.

Figure 5:
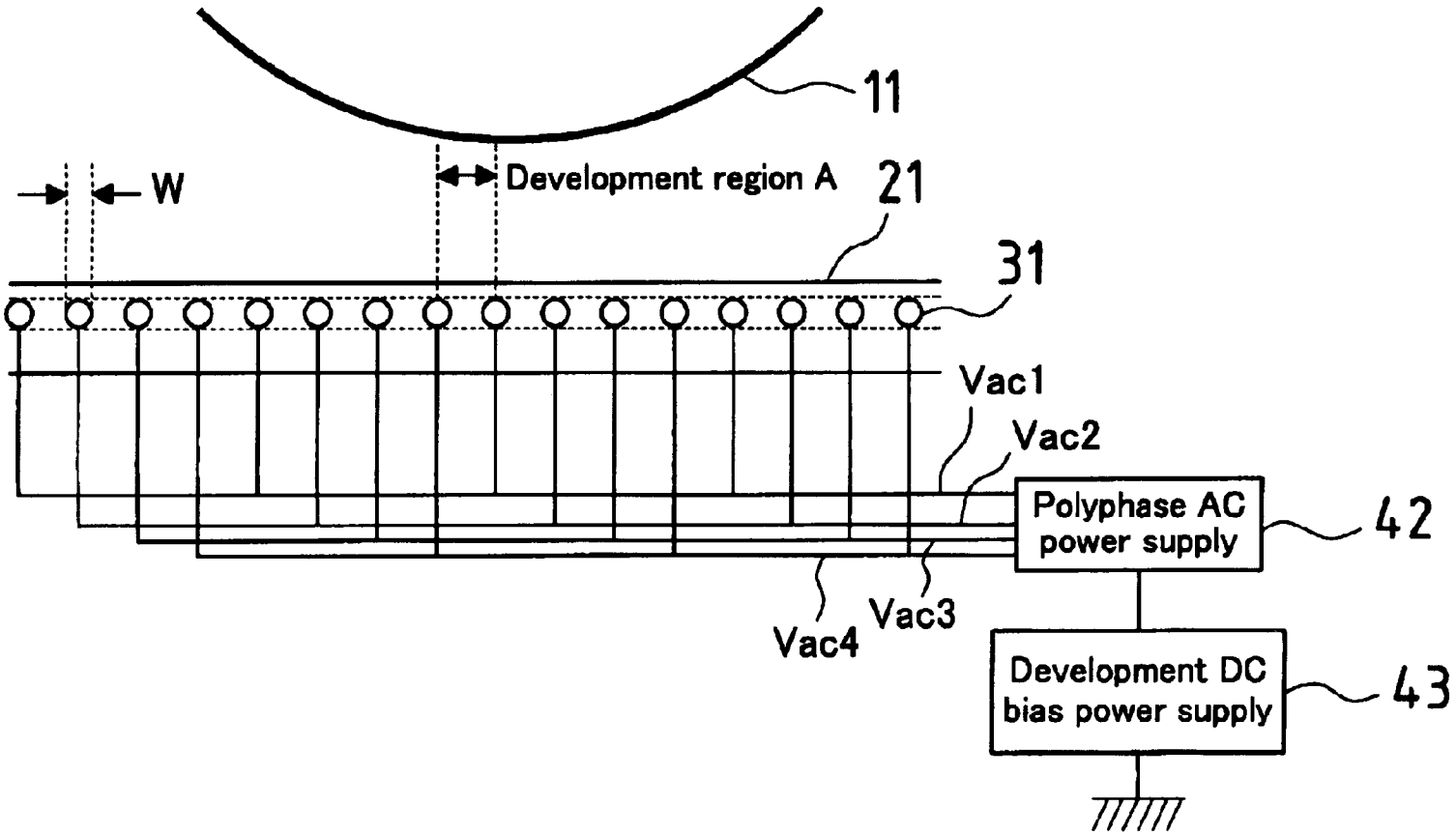
FIG. 5 is an enlarged view showing a photosensitive drum and a toner transport path in the image forming apparatus of FIG. 1.

But superposed on the four phases of AC voltage Vac1 through Vac4 from polyphase AC power supply 42 is development DC bias voltage from development DC bias power supply 43, development electric field(s) produced by the development DC bias voltage being formed in a development region A where photosensitive drum 11 approaches toner transport path 21, as shown in FIG. 5. Such development electric field(s) cause toner to be cast from toner transport path 21 toward the latent electrostatic image on photosensitive drum 11, and toner adheres to the latent electrostatic image, forming a toner image.

Now, the amount of charge present at the toner and the layer thickness thereof vary over time and in dependence upon ambient conditions. Such variations in toner contribute to variation in the amount of toner supplied from supply roller 23 to toner transport path 21, and therefore to variation in the amount of toner supplied from toner transport path 21 to photosensitive drum 11, causing development nonuniformity and interfering with stable image formation.

In the present embodiment, a rear electrode 27 is therefore arranged at a location at the back of toner transport path 21 opposite supply roller 23, and rear electrode 27 is moreover embedded in support 28, toner-supply voltage(s) from rear electrode power supply 44 being applied to rear electrode 27, toner-supplying electric field(s) being formed in the vicinity of supply roller 23, toner-supplying voltage(s) from rear electrode power supply 44 being varied as appropriate, and intensity or intensities of toner-supplying electric field(s) being adjusted so as to permit increased stability in toner supply amount.

As examples of material which may be used for rear electrode 27, stainless steel, iron, aluminum, copper, and other such metals, or rubber or synthetic resin to which a material imparting electrical conductivity thereto has been added, and the like may be cited.

Figure 6:
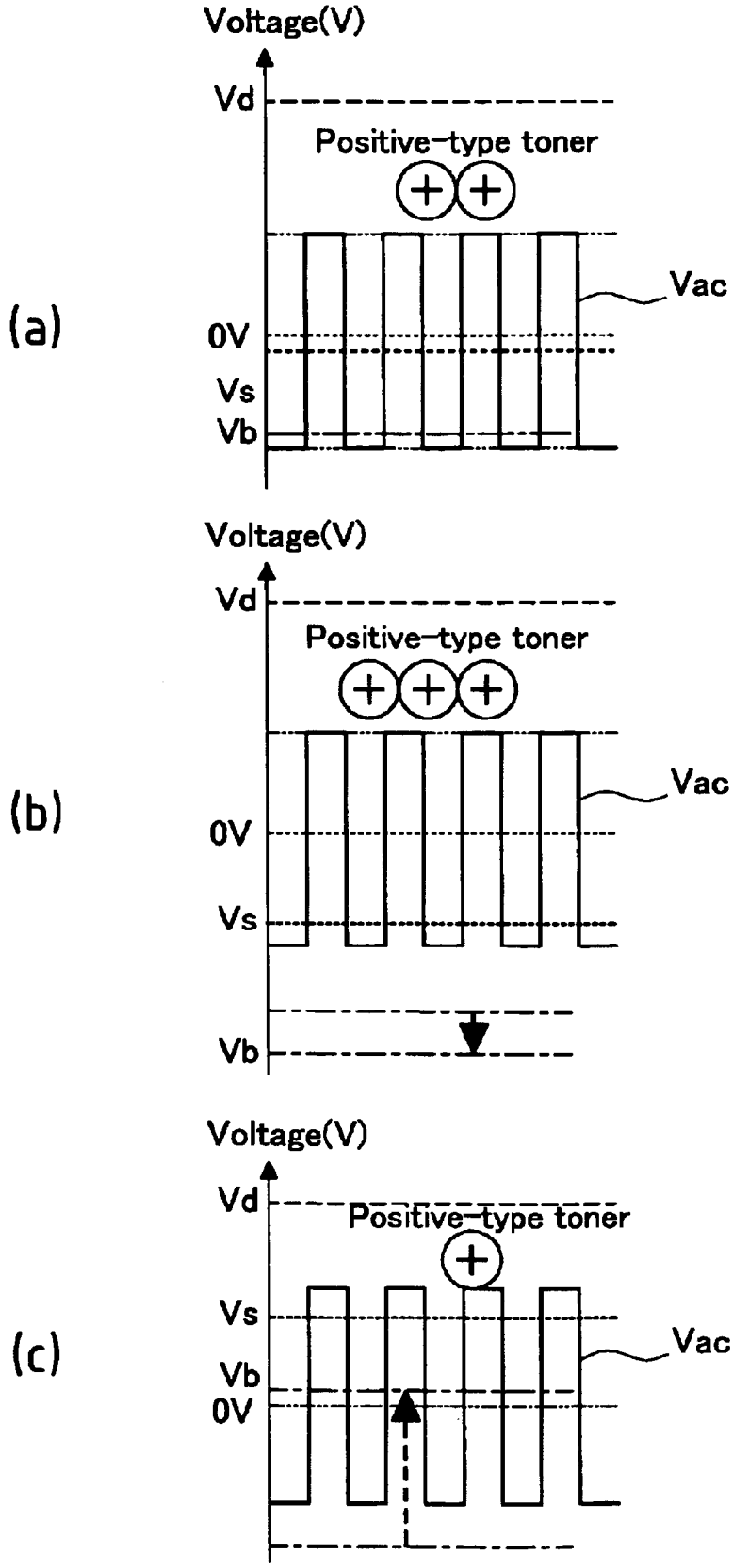
FIG. 6(*a*) shows normal AC voltage Vac, supply roller DC bias voltage Vd, and toner-supplying voltage Vb at the developer apparatus of FIG. 2, with FIG. 6(*b*) showing voltage Vb for increased toner-supplying electric field intensity and FIG. 6(*c*) showing voltage Vb for decreased toner-supplying electric field intensity therein.

As shown in FIG. 6(*a*), AC voltage Vac is applied to traveling-wave-generating electrodes 31 in toner transport path 21, and prescribed supply roller DC bias voltage Vd is applied to supply roller 23, a traveling-wave electric field being formed by the difference in electric potential between AC voltage Vac at traveling-wave-generating electrodes 31 and supply roller DC bias voltage Vd at supply roller 23. Furthermore, toner-supplying voltage Vb is applied to rear electrode 27, and a toner-supplying electric field is formed by the difference in electric potential between supply roller DC bias voltage Vd at supply roller 23 and toner-supplying voltage Vb at rear electrode 27.

Here, polyphase AC power supply 42 and supply DC bias power supply 41 supply a constant AC voltage Vac and a constant supply roller DC bias voltage Vd, neither AC voltage Vac nor supply roller DC bias voltage Vd being capable of being altered. Furthermore, rear electrode power supply 44 is such that toner-supplying voltage Vb can be altered. If, for example, the amount of toner being supplied fluctuates such that it decreases, toner-supplying voltage Vb at rear electrode power supply 44 might be lowered as shown in FIG. 6(*b*), increasing the difference in electric potential between supply roller DC bias voltage Vd and toner-supplying voltage Vb, and increasing the intensity of the toner-supplying electric field. This permits the amount of toner being supplied from supply roller 23 to toner transport path 21 to be increased, eliminating the toner shortage. Furthermore, if the amount of toner being supplied fluctuates such that it increases, toner-supplying voltage Vb at rear electrode power supply 44 might be raised as shown in FIG. 6(*c*), decreasing the difference in electric potential between supply roller DC bias voltage Vd and toner-supplying voltage Vb, and decreasing the intensity of the toner-supplying electric field This permits the amount of toner being supplied to be decreased, eliminating the excess supply of toner.

Accordingly, fluctuation in the amount of toner being supplied may be eliminated without altering AC voltage Vac or supply roller DC bias voltage Vd, and therefore without varying the traveling-wave electric field or the development electric field, and so without destabilizing toner transport or producing unexpected behavior in the development process or effect on transport of toner, permitting stabilization of toner supply and permitting achievement of improved stability in image formation. Furthermore, while polyphase AC power supply 42 and supply DC bias power supply 41 form and output a plurality of AC voltages and a plurality of DC bias voltages, because no change is made to the respective AC voltages or the respective DC bias voltages, circuit construction therefor can be achieved simply and cost can be kept low. Furthermore, because rear electrode power supply 44 is such that it is only the one toner-supplying voltage Vb which is changed, there is no special need for complicated circuit construction, allowing cost to be kept low.

Note in the present embodiment that AC voltage Vac, supply roller DC bias voltage Vd, and toner-supplying voltage Vb have been chosen based on the assumption that toner of positive polarity is being used. Accordingly, when using toner having different charging characteristics, respective voltages Vac, Vd, and Vb will need to be altered as appropriate in correspondence to the charging characteristics of that toner.

Figure 7:
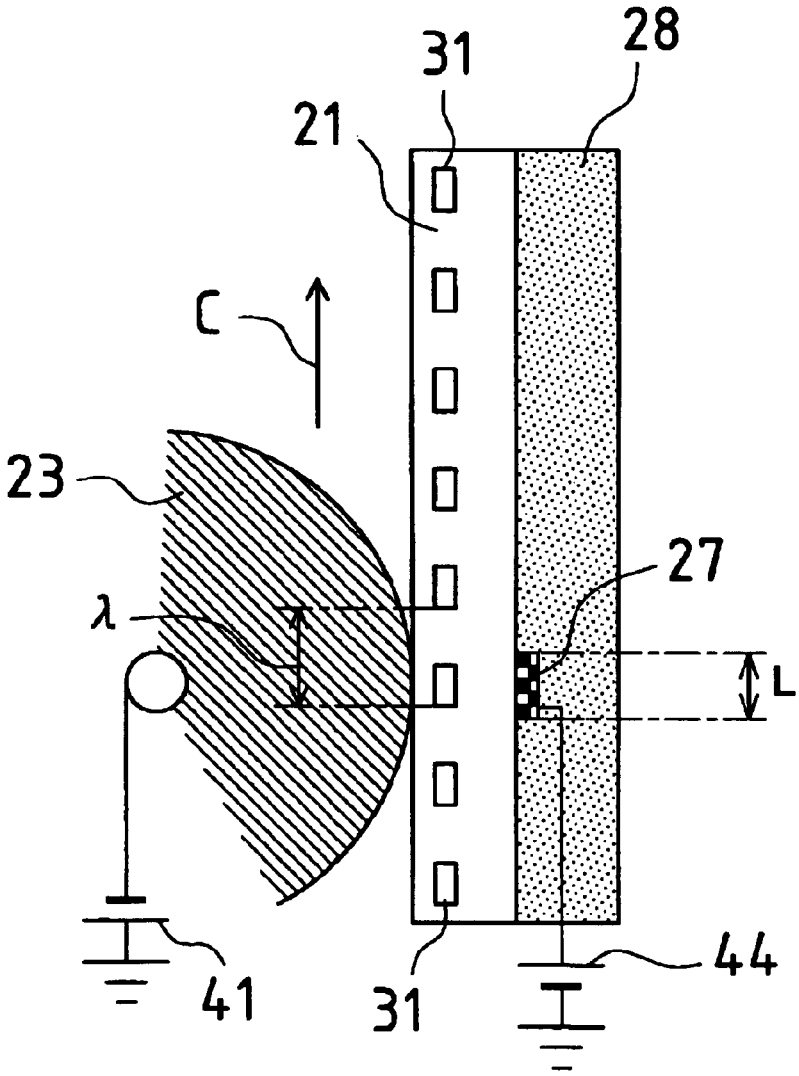
FIG. 7 is a drawing showing a situation where a rear electrode width is less than a pitch between respective traveling-wave-generating electrodes.

Now, as shown in FIG. 3, width L of rear electrode 27 is chosen so as to be sufficiently larger than pitch k between respective traveling-wave-generating electrodes 31. By so doing, formation of a toner-supplying electric field between supply roller 23 and rear electrode 27 is assured, permitting satisfactory control of toner supply amount by means of the toner-supplying electric field. If, as shown at FIG. 7, width L of rear electrode 27 were to be made smaller than pitch $\lambda$ between respective traveling-wave-generating electrodes 31, the toner-supplying electric field produced by rear electrode 27 would be more or less shielded by the respective traveling-wave-generating electrodes 31, making it impossible to use the toner-supplying electric field to control toner supply amount.

Figure 8:
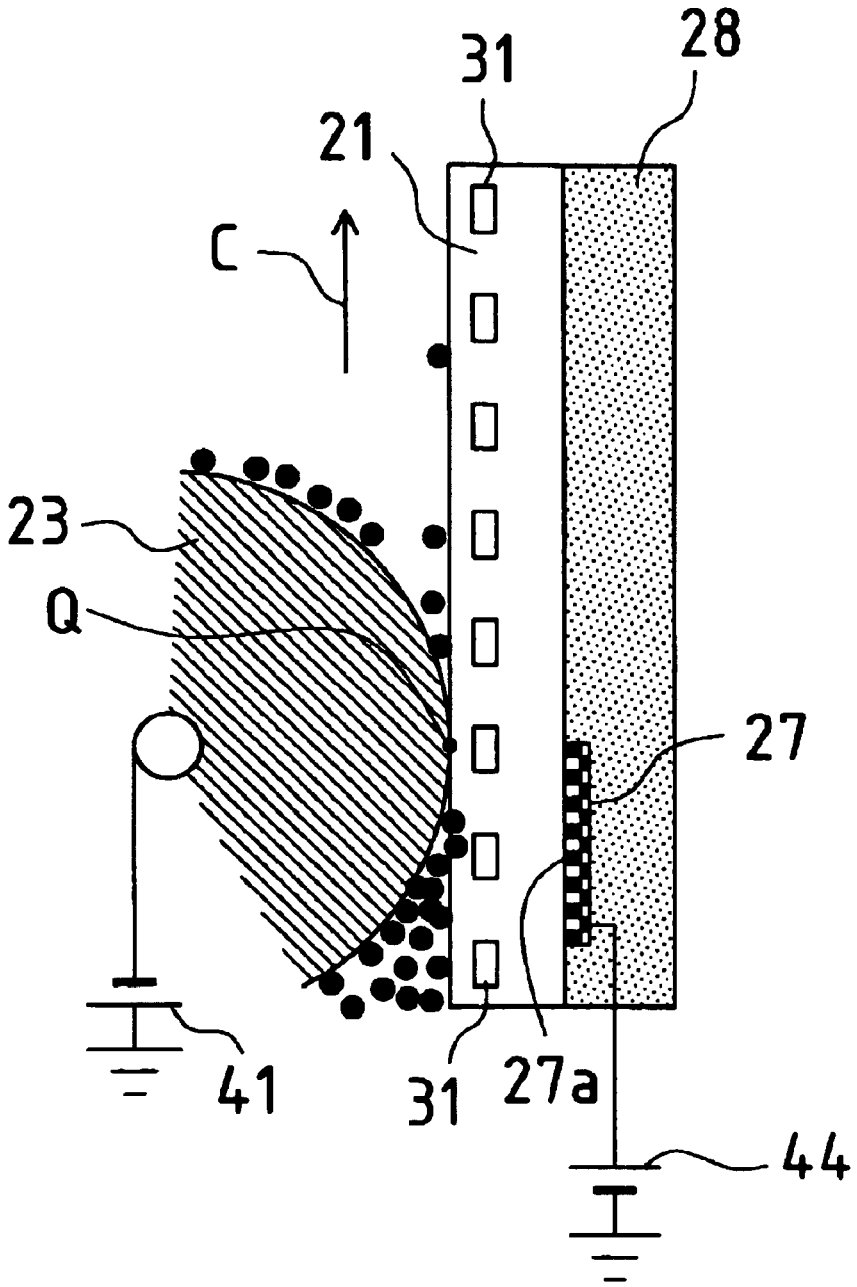
FIG. 8 is a drawing showing a situation where a center of a rear electrode is displaced in a direction opposite a toner transport direction from a nip region formed by contact between a supply roller and a toner transport path.

Furthermore, as shown in FIG. 3, center 27*a* of rear electrode 27 is displaced in the toner transport direction from nip Q formed by contact between supply roller 23 and toner transport path 21. This causes the intensity of the toner-supplying electric field to be greatest at a location displaced in the toner transport direction from nip Q, causing toner to be effectively supplied to such location and moreover causing toner to be smoothly transported along toner transport path 21. If, as shown at FIG. 8, center 27*a* of rear electrode 27 were to be displaced in a direction opposite the toner transport direction from nip Q, the intensity of the toner-supplying electric field would be greatest at a location displaced in a direction opposite the toner transport direction from nip Q, which is to say at a location to the front of supply roller 23, causing toner to become concentrated at such location, and such concentrations of toner would block transport of said toner and cause toner to accumulate where supply roller 23 presses against toner transport path 21, destabilizing supply of toner. Accordingly, it is necessary that center 27*a* of rear electrode 27 either be opposite nip Q formed by contact between supply roller 23 and toner transport path 21 or be displaced in the toner transport direction from said nip Q.

Figure 9:
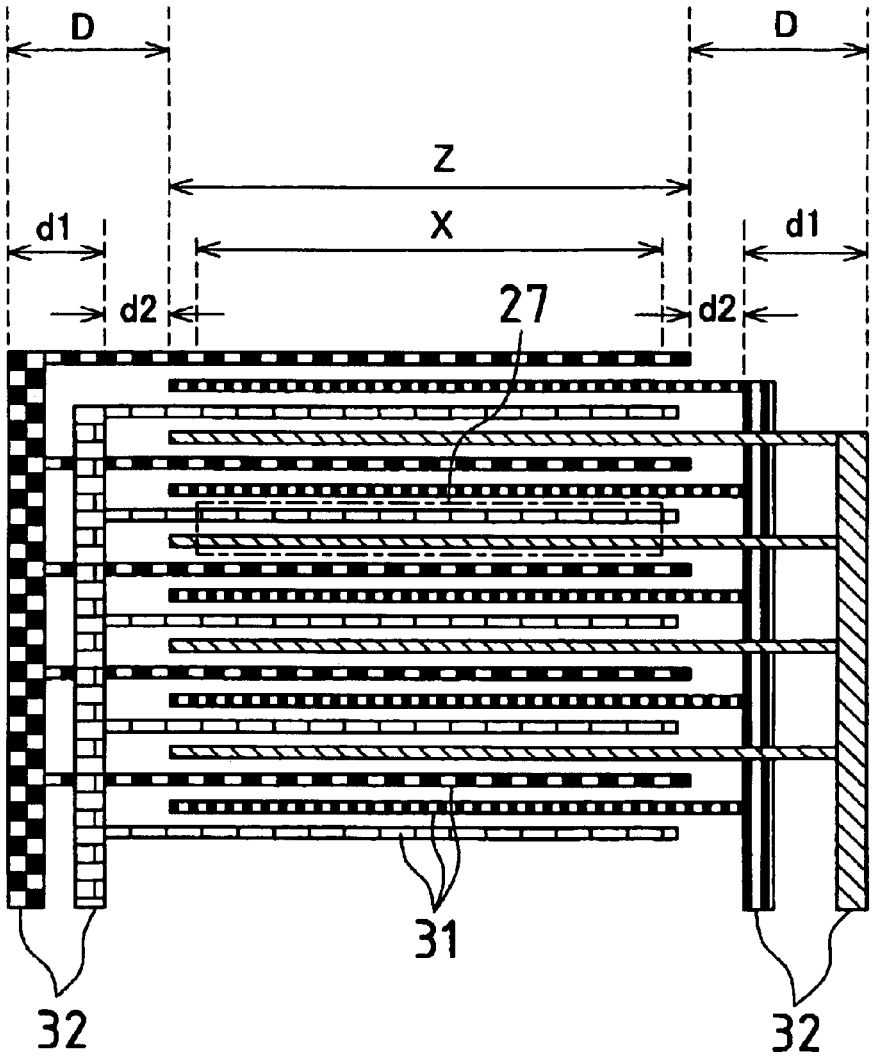
FIG. 9 is a plan view for comparison of respective traveling-wave-generating electrodes and a rear electrode in a toner path in the developer apparatus of FIG. 2.

FIG. 9 is a plan view for comparison of respective traveling-wave-generating electrodes 31 and rear electrode 27 in toner transport path 21. As is clear from FIG. 9, length X of rear electrode 27 is smaller than length(s) Z of respective traveling-wave-generating electrodes 31. Respective traveling-wave-generating electrodes 31 are such that those electrodes which are to receive application of the same phase of AC voltage are connected in common by a common electrode 32 after the fashion of the teeth of a comb, and the respective phases of AC voltage are applied to these common electrodes 32. The complicated pattern at region(s) d1 of respective common electrodes 32 and region(s) d2 where no electrode is present, i.e., at regions D at either end of respective traveling-wave-generating electrodes 31, causes disruption of the traveling-wave electric field. Accordingly, transport of toner is destabilized in regions D at either end thereof, it being preferred that transport of toner not take place thereat. Length X of rear electrode 27 is therefore made smaller than length(s) Z of respective traveling-wave-generating electrodes 31, inhibiting transport of toner at regions D at either end thereof, there being no supply of toner to regions D to either end. If transport of toner were to occur at regions D at either end thereof, not only would transport of toner become destabilized but toner transport path 21 would become soiled and/or toner would be scattered, soiling the interior of the image forming apparatus.

Furthermore, in addition to DC toner-supplying voltage Vb, an AC toner-supplying voltage may be applied to rear electrode 27 from rear electrode power supply 44, and an alternating electric field may be chosen for use as toner-supplying electric field. Toner tends to accumulate in layers and adhere to supply roller 23. If an alternating electric field is used as toner-supplying electric field, toner layers may be broken up by the periodic variation between high and low toner-supplying electric field intensities. This permits supply of toner to be made uniform and stable. Also, while the traveling-wave electric field(s) produced by respective traveling-wave-generating electrodes 31 comprises or comprise a plurality of alternating electric fields, the frequency or frequencies, electric field intensity or intensities, phase difference(s), and so forth thereof may be optimized for transport of toner. Accordingly, it is desirable that, completely separate from traveling-wave electric field(s), alternating electric field(s) representing toner-supplying electric field(s) be such that the frequency or frequencies and/or electric field intensity or intensities thereof is or are optimized for uniform and stable supply of toner.

Moreover, it is preferred that such AC toner-supplying voltage be applied only to rear electrode 27, and that it not be applied to supply roller 23. If an AC toner-supplying voltage were to be applied to supply roller 23, such alternating electric field representing the toner-supplying electric field would also act at toner transport path 21 in the vicinity or vicinities of supply roller 23. Or such alternating electric field might also act at blade 26 for restricting toner layer thickness, supplemental supply members (not shown) for smooth supply of toner, and so forth. This might then cause problems with layer formation of toner being transported by toner transport path 21. It is moreover possible that action of such alternating electric field could extend as far as the vicinity of development region A at photosensitive drum 11, and if electric field(s) in the vicinity of such development region A is or are disrupted this would negatively affect the development process. Such AC toner-supplying voltage is therefore applied only to rear electrode 27, causing region(s) at which such alternating electric field(s) is or are produced to be concentrated between rear electrode 27 and supply roller 23, and inhibiting action of such alternating electric field(s) at regions peripheral thereto.

Furthermore, alternating electric field frequency f1, number N of phases of polyphase AC voltage, traveling-wave electric field frequency f2, width L of rear electrode 27, and pitch λ between respective traveling-wave-generating electrodes 31 are chosen so as to satisfy the condition $(L/\lambda)\times(1/(N\times f2))>1/f1$ is satisfied, where f1 is the frequency (Hz) of the alternating electric field representing the toner-supplying electric field, N is the number of phases of the polyphase AC voltage which forms the traveling-wave electric field, f2 is the frequency (Hz) of the traveling-wave electric field, L is the width (m) of rear electrode 27 in the toner transport direction, and λ is the pitch (m) between respective traveling-wave-generating electrodes 31 in toner transport path 21.

Here, taking the case of two adjacent traveling-wave-generating electrodes 31 in toner transport path 21, the time during which toner is moving between said respective traveling-wave-generating electrodes 31 corresponds to the time during which an electric potential difference exists between said respective traveling-wave-generating electrodes 31. Choosing four rectangular waves mutually differing in phase by 90° and having duty cycles of 50% or more as shown in FIG. 4 for use as four-phase AC voltages Vac1 through Vac4 maximizes the time during which an electric potential difference exists between two adjacent traveling-wave-generating electrodes 31 and increases the time during which movement of toner occurs. In such a case, the time during which toner is moving across the space between two adjacent traveling-wave-generating electrodes 31 will be $1/(N\times f2)$. Furthermore, there will be $L/\lambda$ spaces between respective traveling-wave-generating electrodes 31 within the region of rear electrode 27. Accordingly, $\Delta t=(L/\lambda)\times(1/(N\times f2))$, where Δt is the time during which toner is moving within the region of rear electrode 27. Moreover, in order that the alternating electric field representing the toner-supplying electric field act on toner for at least one cycle within the region of rear electrode 27, and to thus promote uniformity and stability in supply of toner, it will be necessary to make Δt greater than the alternating electric field period (1/f1). Accordingly, if the condition $(L/\lambda)\times(1/(N\times f2))>1/f1$ is satisfied, supply of toner will be made uniform and stable, and image formation will in turn be made stable.

For example, if the number N of phases of polyphase AC voltage is equal to 4 and alternating electric field frequency f1 is equal to 1000 (Hz), then the time $1/(N\times f2)$ during which toner is moving across the space between two adjacent traveling-wave-generating electrodes 31 will be equal to $1/(4\times1000)=250$ (μs). And if the width L of rear electrode 27 is equal to 5 (mm) and the pitch λ between respective traveling-wave-generating electrodes 31 is equal to 250 (μ), then the number of spaces $(L/\lambda)$ between respective traveling-wave-generating electrodes 31 present within the region of rear electrode 27 will be equal to 5/0.25=20. Accordingly, the time Δt during which toner is moving within the region of rear electrode 27 will be $(L/\lambda)\times(1/(N\times f2))=20\times250$ (μs)=5000 (μs)=5 ms. And if the frequency f1 of the alternating electric field representing the toner-supplying electric field is chosen to be 500 (Hz), then the period (1/f1) of the alternating electric field will be 1/500=2 (ms). In such a case, the time Δt=5 (ms) during which toner is moving within the region of rear electrode 27 will be greater than the period (1/f1)=2 (ms) of the alternating electric field, and the condition $(L/\lambda)\times(1/(N\times f2))>1/f1$ will be satisfied, allowing the alternating electric field to act on toner for at least two cycles within the region of rear electrode 27 and making supply of toner uniform and stable.

In addition, where polyphase AC voltage(s) is or are three-phase, three rectangular waves mutually differing in phase by 90° and having duty cycles of 50% or more may be chosen for use as three-phase AC voltage(s).

The table at FIG. 10 shows results of testing in which toner transport was evaluated and determination was made as to whether the condition $(L/\lambda)\times(1/(N\times f2))>1/f1$ was satisfied with respectively appropriately chosen values for number N of phases of polyphase AC voltage, alternating electric field frequency f1, traveling-wave electric field frequency f2, width L of rear electrode 27, and pitch λ between respective traveling-wave-generating electrodes 31. As is clear from this table, where the condition $(L/\lambda)\times(1/(N\times f2))>1/f1$ was satisfied, transport of toner was satisfactory.

Furthermore, stopping supply of toner from supply roller 23 to toner transport path 21 in mid-supply thereof causes binding of toner layer(s) at toner transport path 21, and such toner layer(s) negatively affect supply of toner the next time that supply thereof is attempted. This might for example deleteriously affect attempts to increase uniformity and stability of supply, or vibrations from the exterior might serve to dislodge and scatter toner layer(s). When stopping the image forming apparatus, the toner-supplying voltage from rear electrode power supply 44 is therefore switched to a non-toner-supplying voltage. For example, where a negative voltage is employed as a toner-supplying voltage Vb which is applied at rear electrode 27 from rear electrode power supply 44 so as to form a toner-supplying electric field during operation of the image forming apparatus, a positive voltage might be employed as a non-toner-supplying voltage which is applied at rear electrode 27 from rear electrode power supply 44 so as to form a non-toner-supplying electric field prior to stopping of the image forming apparatus. Doing so will permit supply of toner from supply roller 23 to toner transport path 21 to be inhibited. If toner in toner transport path 21 is transported in such fashion without leaving any of it unrecovered, binding of toner layer(s) can be prevented. And not only that, but because switching from toner-supplying electric field to non-toner-supplying electric field may be carried out by merely switching the voltage applied at rear electrode 27, a large effect may be achieved simply and inexpensively.

Furthermore, as shown in FIG. 3, distance d2 separating respective traveling-wave-generating electrodes 31 and the front of toner transport path 21 is made smaller than distance d1 separating rear electrode 27 and respective traveling-wave-generating electrodes 31, this permitting traveling-wave electric field intensity to be maintained. If, as shown in FIG. 11, distance d1 separating rear electrode 27 and respective traveling-wave-generating electrodes 31 were to be too small, there would be an increase in the degree to which the traveling-wave electric field produced by respective traveling-wave-generating electrodes 31 is directed toward rear electrode 27, reducing traveling-wave electric field intensity and reducing toner transport capability.

Figures 11, 12:
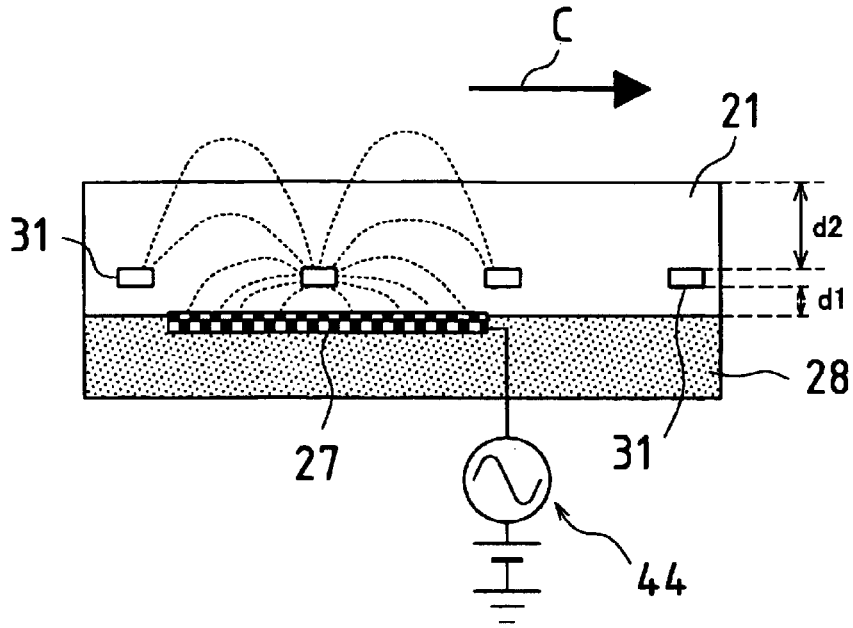
FIG. 11 is a drawing showing a situation where a distance separating a rear electrode and respective traveling-wave-generating electrodes in a toner transport path is too small.
FIG. 12 is a table showing results of testing in which toner transport was evaluated and determination was made as to whether the condition d1>d2 was satisfied with respectively appropriately chosen values for distance d1 separating a rear electrode and respective traveling-wave-generating electrodes, and distance d2 separating respective traveling-wave-generating electrodes and the front of a toner transport path.

The table at FIG. 12 shows results of testing in which toner transport was evaluated and determination was made as to whether the condition d1>d2 was satisfied with respectively appropriately chosen values for each of the distances d1 and d2. As is clear from this table, where the condition d1>d2 was satisfied, transport of toner was satisfactory.

Furthermore, as shown in FIG. 3, distance(s) Bs separating respective traveling-wave-generating electrodes 31 is or are made larger than distance d1 separating rear electrode 27 and respective traveling-wave-generating electrodes 31, this permitting traveling-wave electric field intensity to be maintained. Here, the value of the distance Bs separating respective traveling-wave-generating electrodes 31 is the pitch λ between respective traveling-wave-generating electrodes 31 less the width w of the respective traveling-wave-generating electrodes 31. If, as shown in FIG. 13, distance Bs separating respective traveling-wave-generating electrodes 31 were to be too small relative to distance d1 separating rear electrode 27 and respective traveling-wave-generating electrodes 31, or if distance d1 were to be too large relative to distance Bs, the toner-supplying electric field produced by rear electrode 27 would be more or less shielded by respective traveling-wave-generating electrodes 31, making it impossible to use the toner-supplying electric field to control the amount of toner which is supplied.

Figures 13, 14:
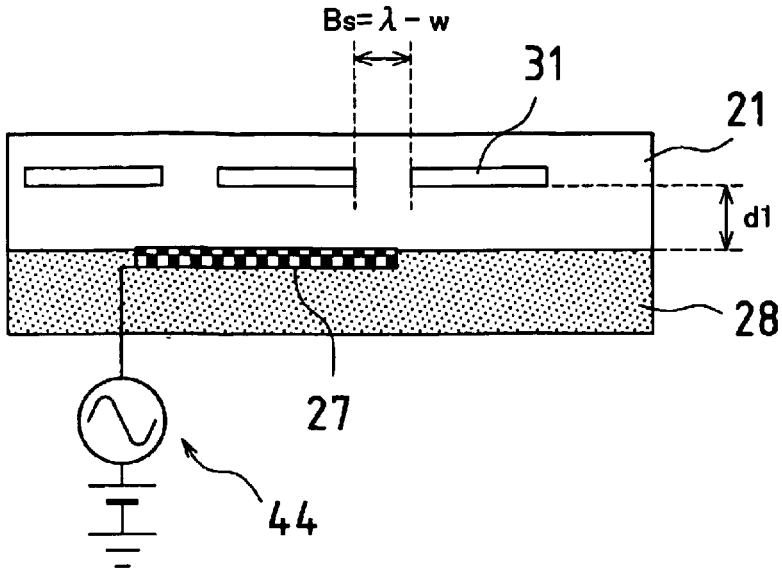
FIG. 13 is a drawing showing a situation where a distance separating respective traveling-wave-generating electrodes is too small relative to a distance separating a rear electrode and respective traveling-wave-generating electrodes.
FIG. 14 is a table showing results of testing in which control of the amount of toner supplied was evaluated and determination was made as to whether the condition Bs>d1 was satisfied with respectively appropriately chosen values for distance d1 separating a rear electrode and respective traveling-wave-generating electrodes, and distance Bs separating respective traveling-wave-generating electrodes.
Figure 15:
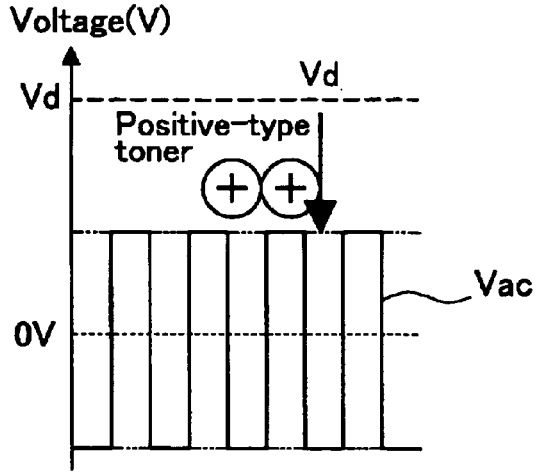
FIG. 15(*a*) shows normal AC voltage Vac and DC bias voltage Vd in a conventional apparatus, with FIG. 15(*b*) showing voltage Vac for increased toner-supplying electric field intensity and FIG. 15(*c*) showing voltage Vd for increased toner-supplying electric field intensity therein.
Figure 15:
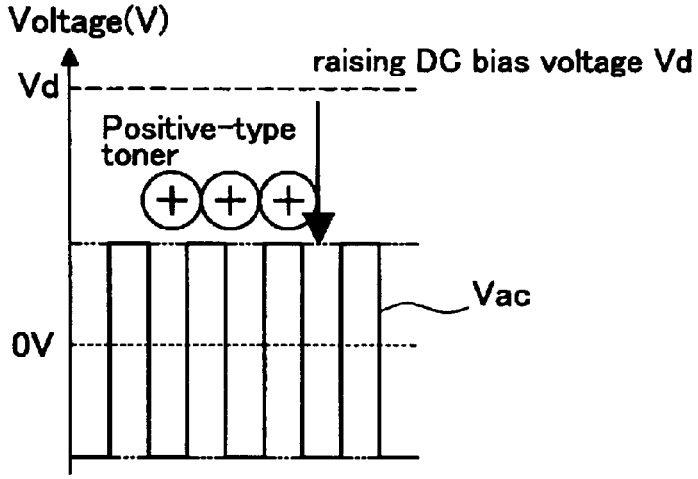
Figure 15:
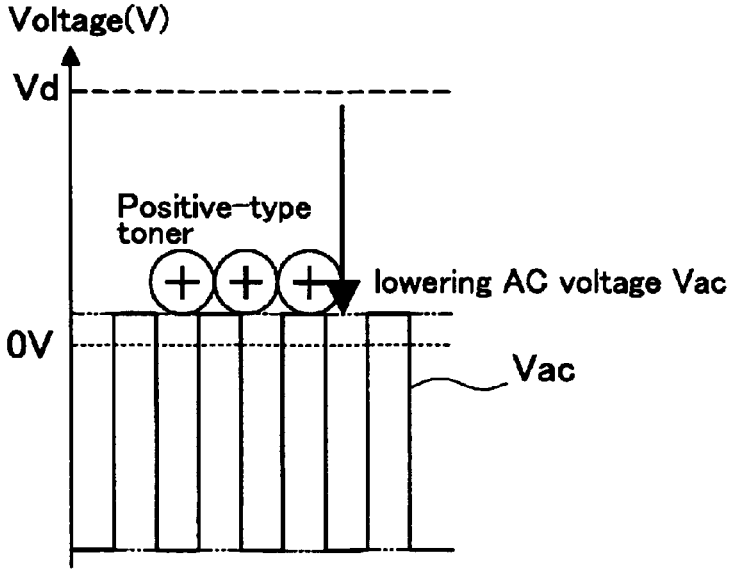

The table at FIG. 14 shows results of testing in which control of the amount of toner supplied was evaluated and determination was made as to whether the condition Bs>d1 was satisfied with respectively appropriately chosen values for each of the distances d1 and Bs. As is clear from this table, where the condition Bs>d1 was satisfied, control of the amount of toner supplied was satisfactory.

Note that the present invention is not limited to the foregoing embodiment but admits of a great many variations thereon. For example, there is no objection to changing size(s) of and/or pitch(es) between respective traveling-wave-generating electrodes 31, voltage value(s) for AC voltage(s) Vac and/or frequency or frequencies thereof, and/or the like so as to appropriately adjust toner transport speed, supply amount, and/or the like. Furthermore, toner recovery member(s) and/or toner supply member(s) which does or do not rotate and/or does or do not make contact with toner transport path(s) 21 may be provided instead of supply roller(s) 23 and/or recovery roller(s) 25. Moreover, while the latent electrostatic image on photosensitive drum 111 is developed in noncontact fashion, toner transport path(s) 21 and photosensitive drum 11 may come in contact. Furthermore, a photosensitive belt or the like may be used instead of photosensitive drum 11. Moreover, the present invention is not limited to electrophotographic image forming apparatuses, it being possible to apply the developer apparatus of the present invention to image forming apparatuses wherein a latent electrostatic image is formed in direct fashion on a dielectric body such as is the case with the ion flow method, or to image forming apparatuses wherein voltage(s) is or are applied to electrode(s) having a plurality of apertures, forming a latent electrostatic image in space, and developer material is cast at a recording medium to carry out image formation in direct fashion, such as is the case with the toner jet method.

The present invention may be embodied in a wide variety of forms other than those presented herein without departing from the spirit or essential characteristics thereof. The foregoing embodiments, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

The present application claims right of benefit of prior filing date of Japanese Patent Application No. 2001-392293, filed on Dec. 25, 2001, entitled "Developer Apparatus and Image Forming Apparatus", the content of which is incorporated herein by reference in its entirety. Furthermore, all references cited in the present specification are specifically incorporated herein by reference in their entirety.

What is claimed is:

1. A developer apparatus equipped with at least one transport path wherein a plurality of electrodes are arranged in at least one row to be mutually separated by at least one prescribed spacing and with at least one developer material supply means arranged at front side of said at least one transport path, said developer material being supplied from said at least one of the developer material supply means to the front side, at least one polyphase alternating current voltage being applied to said plurality of electrodes, at least one traveling-wave electric field being formed and causing at least a portion of the developer material to be transported along the front to an image carrier, and the image carrier causing a latent electrostatic image to be developed, said developer apparatus having a rear electrode arranged at a back side of said at least one transport path opposite said at least one developer material supply means, and a developer-material-supplying electric field being formed between the rear electrode and said at least one developer material supply means.

2. The developer apparatus according to claim 1, wherein a width of the rear electrode in said at least one developer material transport direction is greater than a pitch between said plurality of electrodes in said at least transport path.

3. The developer apparatus according to claim 1 or 2, wherein the rear electrode is disposed with a bias in said at least one developer material transport direction relative to said at least one developer material supply means.

4. The developer apparatus according to claim 1, wherein a length of at least one rear electrode in a direction perpendicular to at least one developer material transport direction is less than a length of said plurality of electrodes in at least one transport path in said perpendicular direction.

5. The developer apparatus according to claim 1, wherein at least one developer-material-supplying electric field is an alternating electric field.

6. The developer apparatus according to claim 5, wherein at least one alternating current voltage corresponding to the alternating electric field is applied to said at least one of the rear electrodes.

7. The developer apparatus according to claim 5 or 6, wherein a condition $(L/\lambda)\times(1/(N\times f2))>1/f1$ is satisfied, where f1 is a frequency of the at least one alternating electric field, N is a number of phases of at least one of the polyphase alternating current voltage which forms at least one of the traveling-wave electric field, f2 is a frequency of said at least one of the traveling-wave electric field, L is a width of said at least one of the rear electrode in said at least one developer material transport direction, and $\lambda$ is said at least one pitch between respective electrodes in said at least one of the transport path.

8. The developer apparatus according to claim 1, wherein the in that supply of developer material from said at least one developer material supply means to the front of said at least one transport path is stopped by switching said at least one developer-material-supplying electric field to a non-developer-material-supplying electric field.

9. The developer apparatus according to claim 1, wherein condition $d1>d2$ is satisfied, where d1 is a distance separating said at least one rear electrode and said plurality of electrodes of said at least one transport path, and d2 is a distance separating said plurality of electrodes of said at least one transport path and the front of said at least one transport path.

10. The developer apparatus according to claim 1, wherein condition $Bs>d1$ is satisfied, where Bs is a distance separating said plurality of electrodes of said at least one transport path, and d1 is a distance separating at least said rear electrode and said plurality of electrodes of said at least one transport path.

11. An image forming apparatus being equipped with at least one developer apparatus equipped with at least one transport path wherein a plurality of electrodes are arranged in at least one row to be mutually separated by at least one prescribed spacing and with at least one developer material supply means arranged at a front side of at least said one transport path, said developer material being supplied from said at least one of the developer material supply means to the front side, at least one polyphase alternating current voltage being applied to said plurality of electrodes, at least one traveling-wave electric field being formed and causing at least a portion of the developer material to be transported along the front to an image carrier, and the image carrier causing a latent electrostatic image to be developed, said developer apparatus having a rear electrode arranged at a back side of said at least one transport path opposite said at least one developer material supply means, and a developer-material-supplying electric field being formed between the rear electrode and said at least one developer material supply means.

12. The image forming apparatus according to claim 11, wherein a width of the rear electrode in said at least one developer material transport direction is greater than a pitch between said plurality of electrodes in said at least transport path.

13. The image forming apparatus according to claim 12, wherein the rear electrode is disposed with a bias in said at least one developer material transport direction relative to said at least one developer material supply means.

14. The image forming apparatus according to claim 11, wherein a length of at least one rear electrode in a direction perpendicular to at least one developer material transport direction is less than a length of said plurality of electrodes in at least one transport path in said perpendicular direction.

15. The image forming apparatus according to claim 11, wherein at least one developer-material-supplying electric field is an alternating electric field.

16. The image forming apparatus according to claim 15, wherein at least one alternating current voltage corresponding to the alternating electric field is applied to said at least one of the rear electrodes.

17. The image forming apparatus according to claims 15 or 16, wherein a condition $(L/\lambda)\times(1/(N\times f2))>1/f1$ is satisfied, where f1 is a frequency of the at least one alternating electric field, N is a number of phases of at least one of the polyphase alternating current voltage which forms at least one of the traveling-wave electric field, f2 is a frequency of said at least one of the traveling-wave electric field, L is a width of said at least one of the rear electrode in said at least one developer material transport direction, and $\lambda$ is said at least one pitch between respective electrodes in said at least one of the transport path.

18. The image forming apparatus according to claim 11, wherein the supply of developer material from said at least one developer material supply means to the front of said at least one transport path is stopped by switching said at least one developer-material-supplying electric field to a non-developer-material-supplying electric field.

19. The image forming apparatus according to claim 11, wherein condition $d1>d2$ is satisfied, where d1 is a distance separating said at least one rear electrode and said plurality of electrodes of said at least one transport path, and d2 is a distance separating said plurality of electrodes of said at least one transport path and the front of said at least one transport path.

20. The image forming apparatus according to claim 11, wherein condition Bs>d1 is satisfied, where Bs is a distance separating said plurality of electrodes of said at least one transport path, and d1 is a distance separating at least said rear electrode and said plurality of electrodes of said at least one transport path.

* * * * *